United States Patent [19]

Chang et al.

[11] 4,378,332

[45] Mar. 29, 1983

[54] ALUMINUM HARDENED COPPER ALLOY

[75] Inventors: Uck I. Chang; Chia-Ming Yen, both of West Bloomfield, Mich.

[73] Assignee: Ford Motor Company, Dearborn, Mich.

[21] Appl. No.: 273,292

[22] Filed: Jun. 15, 1981

[51] Int. Cl.[3] ..... C22C 9/06; C22F 1/08

[52] U.S. Cl. ..... 420/486; 29/156.7 A; 148/414; 148/435; 420/587

[58] Field of Search ..... 29/156.7 A; 75/159; 148/127, 160, 414, 435; 420/486, 587

[56] References Cited

U.S. PATENT DOCUMENTS 2,034,562 3/1936 Davis et al. ..... 75/159
2,240,202 4/1941 Anselmi ..... 75/159
2,330,018 9/1943 van Wert ..... 75/159
3,773,504 11/1973 Niimi et al. ..... 75/157.5

FOREIGN PATENT DOCUMENTS 47-29691 8/1972 Japan ..... 420/485

*Primary Examiner*—Peter K. Skiff
*Attorney, Agent, or Firm*—Joseph W. Malleck; Olin B. Johnson

[57] ABSTRACT

A high temperature wear resistant material is disclosed for use in engine components such as an exhaust valve seat insert to reduce high temperature exhaust valve seat wear. The material consists by weight of about 40–70% Cu, about 20–60% Ni, about 3–14% Al and up to about 1.5% other alloying ingredients with normal processing impurities.

8 Claims, 3 Drawing Figures

ALUMINUM HARDENED COPPER ALLOY

BACKGROUND OF THE INVENTION

High temperature wear has been a significant problem for engine parts such as where an exhaust valve repetitively contacts a valve seat. Most currently produced valve seats are simply made of cast iron or steel enhanced with alloying ingredients which are believed to improve hardness and wear resistance at high temperatures. However, such iron based materials without heat treatment cannot attain sufficient hardness and wear resistance to be useful as a valve seat. With heat treatment, the processing becomes undesirably expensive for modern engines.

Use of cast iron or steel valve seats has not proved entirely successful in aluminum head engines because of the uncontrollable pick up of aluminum to form brittle intermetallic materials in the valve seat. Very little research has been undertaken with the use of noniron based materials compatible with aluminum, such as copper based materials, for valve seats. Copper based materials are typically relatively soft and thus have not been considered candidates for valve seat applications.

SUMMARY OF THE INVENTION

The invention is a more wear resistant facing material useful in high temperature environments such as engine components and particularly a material that will reduce the wear or valve seat recession of an aluminum based engine head. The facing material consists of a copper/-nickel alloy containing 40–70% Cu, 20–60% Ni, 3–14% Al, and up to 1.5% other alloying ingredients with normal processing impurities. The hardness of such material at room temperature is in a range of 25–40 $R_c$. This hardness range remains in effect even when experiencing temperature conditions of 800°–900° F. for 30–215 hours. Such hardness stability is due to stable precipitates and intermetallic phases formed by the use of the specific alloying system.

The material can be shaped as a ring insert for a valve seat engine application; this works particularly well when used as part of an assembly where an exhaust valve, comprised of iron based alloy with high Cr/Ni content, is brought into contact with a valve seat consisting of Cu/Ni/Al, as above set out.

SUMMARY OF THE DRAWINGS

FIG. 3 is a graphical illustration of seat recession wear as a function of test time for an 80/20 dynamometer durability test.

DETAILED DESCRIPTION

Aluminum engines, although desirable because of their greater heat transfer and lighter weight, require special alloys at critical interface locations where rubbing or physical contact takes place between metals such as the exhaust port and the exhaust valve. A new material useful as an insert or integrated material in engine applications such as exhaust valve and seat contactors has been formulated. The material is comprised by weight of about 40–70% copper, about 20–60% nickel, about 3–14 aluminum, and up to about 1.5% other alloying ingredients such as carbon, manganese and iron, along with the usual processing impurities such as sulfur. It is advantageous and preferred if the copper range is limited to 57–64%, nickel to 26–51%, and the aluminum limited to 7–12%. Other alloying ingredients can include titanium and zirconium, each being added for grain refinement; these ingredients should be limited to about 1.5%. Processing impurities is used herein to mean impurities resulting from the ore used to form the metals and the treating agents used during processing. These impurities are controlled by the melter or supplier of the metal ingredients and usually include: for copper, maximum limits of 0.5%, iron, 0.7% Si, 0.5% phosphorous, 0.003% S, 0.001% Bi, 0.005% Pb; for aluminum, 0.25% Si, 0.35% Fe, 0.05% Cu, 0.05% ZN, 0.03% Ti, 0.03% Mn; and for nickel 0.05% Si, 1.5% Mn, 0.25% C and 0.015% S.

Nickel is important to the formation of a wear resistant copper alloy at high temperatures because it forms certain intermetallic phases with aluminum which are particularly desirable in attaining high temperature hardness and high temperature hardness stability. Nickel is also helpful in providing a corrosion resistant material. Critical quantitative use of aluminum provides certain intermetallic compounds with nickel which facilitates high temperature hardness and stability.

The alloy herein does not require heat treating and can be formulated by conventional alloying techniques (described in Metals Handbook, Vol. 5, 8th Ed.), wherein the various ingredients are melted and dissolved within a furnace (gas or electric) and cast directly into a desired shape, which shape is suitable for integration or insert use in the specific contact area of an engine.

Figure 1:
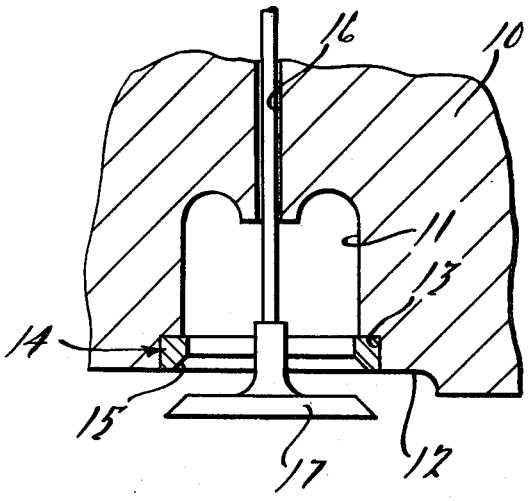
FIG. 1 is a schematic illustration of a portion of an engine assembly using an exhaust valve and exhaust valve seat with an insert in accordance with this invention.

As shown in FIG. 1, an engine housing (head) 10 is typically cast of aluminum with intake and exhaust ports 11 interrupting the combustion chamber roof 12, commonly called a port opening. The shoulder 13 about the port opening is grooved to receive the cast shape as an insert 14. The insert is usually annular with a square of rectangular cross-section and conical face 15 at one corner. The insert can be integrated to the housing by a shrink-fit, or bonded thereto by welding (i.e., electron beam welding, brazing, etc.).

Alternatively, the insert 14 can be formed by using a copper/nickel alloy as a base ring shape; aluminum is laser melted onto a zone of the shape by wire feeding or as an additional ring. The resulting laser melted alloy should have an alloy constituency within the ranges specified above. The crystalline structure resulting from such laser melting is desirable because of its fine microstructure. To ensure greater uniformity of a cast alloy material, it is desirable to cast all the alloying ingredients directly into the shape desired and then subsequently laser heat the shape to refine the crystalline structure of the material. Nonuniformity has been discovered to be an important factor in increasing the wear of the particular material by a phenomenon known as non-uniformity hypothesis (Ford Motor Company Technical Report No. SR. 80–27). The wear is increased by localized high contact stress analogous to contacting a number of needle points. By directly casting the alloy ingredients of this invention, coupled with subsequent laser heating, such uniformity can be ensured, leading to improved wear resistance of the alloy.

The intermetallic or precipitate particles in the alloy do not grow larger with higher temperatures and thus maintain a stable geometry to ensure uniformity.

Figure 2:
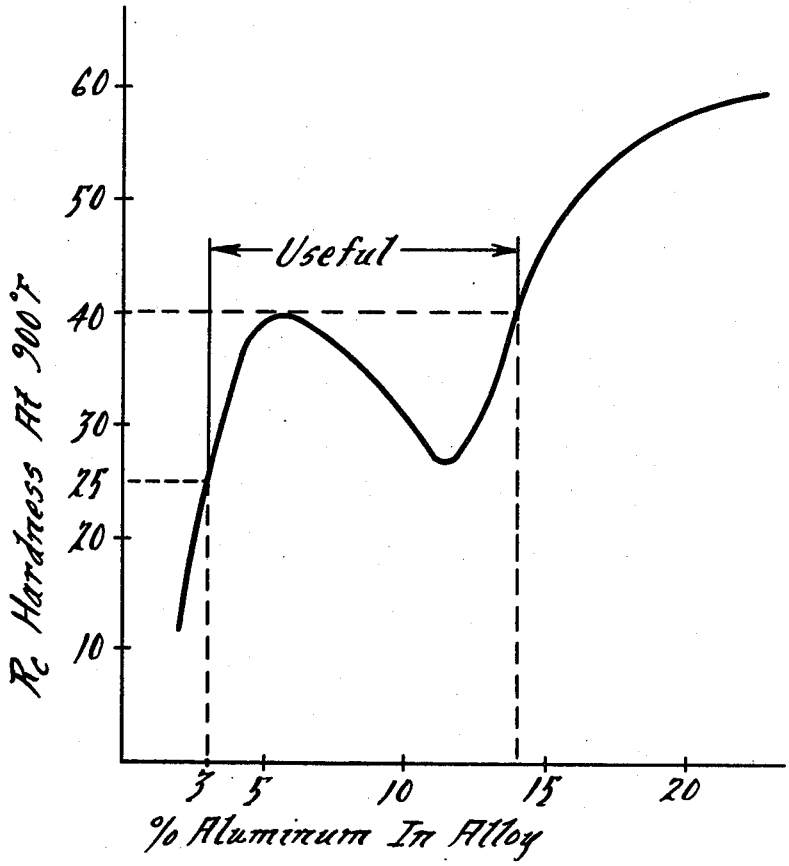
FIG. 2 is a graphical illustration of hardness as a function of aluminum content for the material of this invention.
Figure 2:
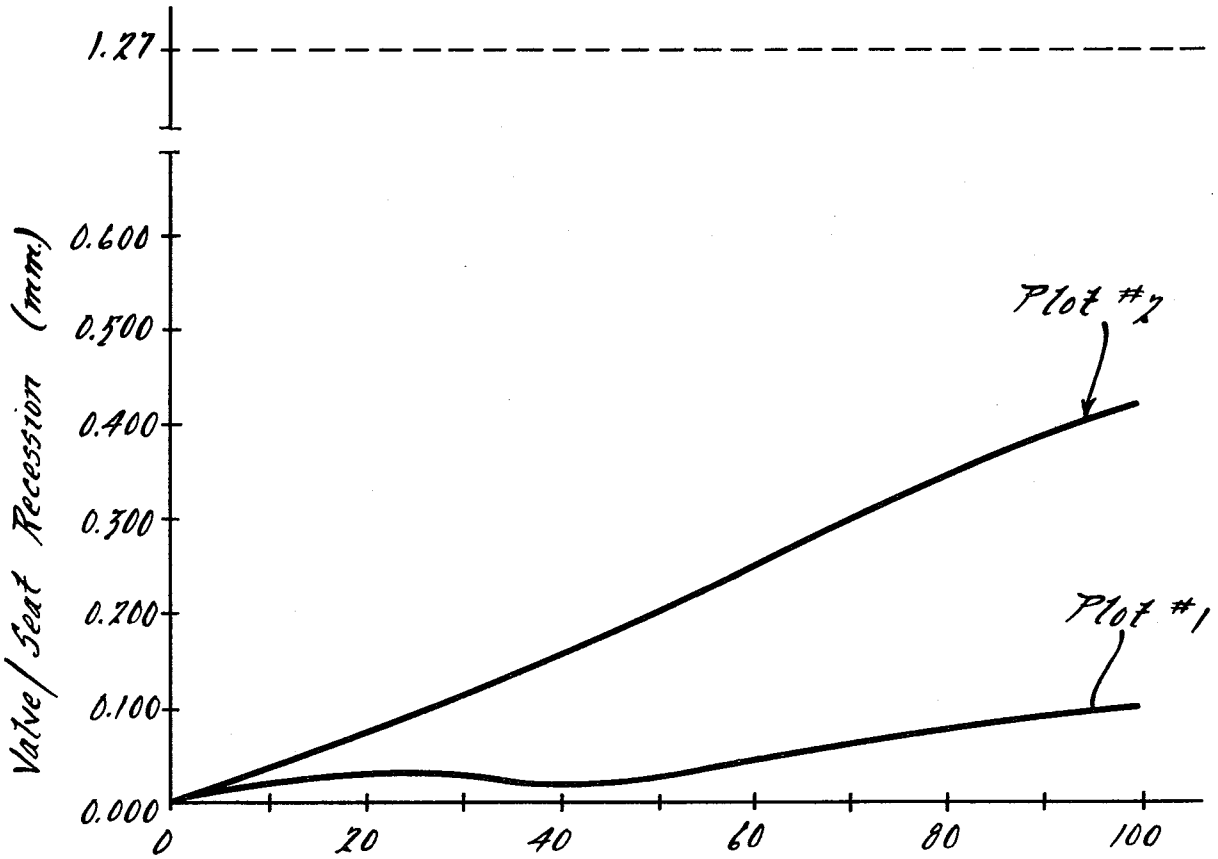

Aluminum variation in Cu/Ni alloys shows that the hardness level increases with increasing aluminum content from 3.0% aluminum to 14.0% aluminum (see FIG. 2). Aluminum of higher than 14.0% resulted in excessive, brittle phases (intermetallic compounds of aluminum/copper and aluminum/nickel). Aluminum percentages lower than 3% do not harden the alloys effectively. FIG. 2 shows that the useful range of aluminum is between 3–14% to obtain high temperature hardness values between 25–40 $R_c$. The increase in hardness is believed to be due to solid solution hardening, precipitation hardening, and contribution from hard second phases (intermetallic compounds).

If the aluminum content is equal to or less than 1.5%, it has been found that the cast material will be a solid solution of Cu, Ni and Al. When the content of aluminum is between 1.5–6%, $Ni_3Al$ will begin to be present. When the aluminum content is between 6–7%, an additional secondary phase is present as NiAl. For aluminum contents between 7–10%, secondary phases include $Ni_3Al$, NiAl, $Cu_3Al$, and some $Cu_9Al_4$. For aluminum contents between 10% and up to 18%, the secondary phases are similar, with NiAl slowly disappearing with increasing Al. For aluminum contents in excess of 18%, additional phases of $Cu_9Al_4$, $Cu_2Al$ and $Ni_2Al_3$ appear.

It is preferable that only the secondary phases of $Cu_3Al$, NiAl and $Ni_3Al$ be present.

An aging study was carried out which involved heating the various types of alloy examples in Table 1 to the temperature level of 900° F. for a period of up to 215 hours. Such study showed that both the hardness and the structure of the alloy tested remained stable at this temperature level and for the indicated period of time. For example, the 61.5 Cu/31.2 Ni/6.1 Al alloy exhibits a high temperature hardness range of 35–36 $R_c$ when exposed for 30–215 hours at temperature levels of 700°–900° F. The specific ingredients of the alloys that were subjected to the aging study are shown in Table 1. All tested alloys showed very little change in hardness during high temperature use and were considered stable. The hardness trace for one specific alloy is shown in Table II; the alloy consisted of 31% Ni, 0.07% C, 0.75% Mn, 0.45% Fe, 0.005% S, 0.10% Si, 67.5% Cu, 3% Ti and 9% Al.

Durability tests were carried out to confirm the belief that these specific alloys had highly reduced recession or wear when used as a valve seat material. To carry out this test, an aluminum cast cylinder head was prepared. A copper/nickel alloy, commercially known as Monel 413 welding wire consisting of 31% Ni, 61.5% Cu and small amounts (1.4%) of Mn, Fe and Ti, was modified by melting and adding aluminum in an amount of 6.1%. The aluminum was added as an alloying hardening element. The modified alloy was cast in a permanent mold to form bar stock. The resultant bar stock was then machined into rings. The inside corners of the rings were melted using a laser device; the laser treated rings were machined into exhaust seat inserts and shrunk-fit (0.076 mm interference) into port grooves of a water cooled aluminum cylinder head.

Intake seats for such tests were prepared by laser surface alloying aluminum annulus specimens using either the machined ring technique or a wire feeding technique. These alloyed annulii were machined into intake seat inserts and then electron beam welded to the test aluminum cylinder heads.

Valve guides 16 were comprised of iron and the exhaust valves 17 were comprised of either 21–4 N (which is 21% Cr, see SAE EV-8) valve alloy or a Ford production exhaust valve alloy comprised of cast austenitic stainless steel valve with an aluminum coating (see Ford specification ESE-MIA-92-A, which comprises 0.74–0.95% C, 15–18 Cr, 13–16 Ni, 0.3–0.6 Mn, 2–3.5 Si, 1.0% maximum Mo, 1.0% maximum Cu, 3.0% maximum Co, and 0.2% maximum impurities.

The test method comprised operating the engine for 100 hours in an 80/20 dynamometer durability test using unleaded gasoline. Such 80/20 dynamometer test comprises 80 hours of high speed, maximum power engine operation, followed by 20 hours of maximum engine torque operation. The test was performed with periodic measurement inspection at 10 hour intervals. Valve tip height measurements were made as an indicator of both valve and seat recession. The results of the dynamometer test, as shown in FIG. 3, showed exhaust valve recession range from 0.1 mm to 0.4 mm after 100 hours. Analysis of the exhaust valve and seat surfaces for the 0.1 mm wear (Plot #1) showed them to be somewhat smooth. The hard 21–4 N valve apparently contributed to reducing the adhesive wear and preventing surface plastic deformation. However, when the exhaust valve was comprised of the Ford production exhaust valve alloy, some material transfer occurred in both directions, from the seat to the valve and from the valve to the seat, indicating that both the valve and the seat underwent adhesive wear (see Plot #2). The valve face showed a heavier edge metal flow than the seat face; the valve ($R_c$26) is softer than the seat ($R_c$32). The direction of plastic flow indicated that the high firing pressure and valve seating pressure are responsible for the deformation. Nonetheless, recession was still low with 0.4 mm after 100 hours. The use of the alloy herein enables wear recession of 0.254 mm or less to be obtained at the conclusion of a 100 hour dynamometer test.

It appears that the main cause of failure of earlier alloys not in accordance with this invention was the nonuniform geometry resulting from the nonuniform hardness of a surface alloyed seat. A hardness survey was made of the laser surface melted aluminum annular specimen made in accordance with this invention. The hardness variation was not noticeable and had a reasonable amount of uniformity. Thus, the valve and seat conformed on contact after the initial wear-in and avoided accelerated wear. Accelerated or unwanted wear is used herein to mean wear recession of a valve seat of about 0.3 mm or more when the seat is engaged by a metal valve of generally the same or harder material for 100 hours of dynamometer use and 0.5 mm or more when the engaging valve metal is somewhat softer than the seat. The uniformity of the exhaust seat is believed to be a feature of the present invention.

The exhaust valve seats which are made by integrating the annulus to the base aluminum head tend to run 100°–150° cooler during the dynamometer test. Thus, wear behavior is improved on using an integrally alloyed aluminum cylinder head.

TABLE I

| Cu | Ni | Al | Others |
|---|---|---|---|
| 63.1 | 28.9 | 2.4 | 5.6 |
| 64.8 | 30.6 | 3.1 | 1.5 |
| 61.5 | 31.2 | 6.1 | 1.2 |

TABLE I-continued

| Cu | Ni | Al | Others |
|---|---|---|---|
| 61.5 | 26.2 | 8.7 | 3.6 |
| 60.8 | 27.9 | 10.0 | 1.4 |
| 59.1 | 27.1 | 12.5 | 1.3 |
| 57.4 | 26.4 | 15.0 | 1.3 |

TABLE II

| Furnace Hours | Hardness |
|---|---|
| 0 | 35 |
| 30 | 36 |
| 66 | 36 |
| 120 | 35 |
| 215 | 37 |

We claim:

1. An as-alloyed annular high temperature wear resistant exhaust valve seat insert for use in an internal combustion engine, said insert consisting of about 40–70% Cu, about 20–60% Ni, about 3–14% and up to about 1.5% other metallic alloying ingredients with the normal processing impurities, said insert having a hardness in the range of 25–40 $R_c$ when experiencing temperatures of 800°–900° F.

2. An exhaust valve seat insert for use in an internal combustion engine, said engine having an exhaust port with walls defining an annular grooved mouth, said insert comprising a machinable annular member integrated in and to said grooved mouth, said member consisting of an as-alloyed material forming about 57–64% Cu, about 26–51% Ni, about 7–12% Al, and up to about 1.5% other alloying ingredients with the normal processing impurities.

3. The insert as in claim 2, in which said insert has a stable hardness range of 25–30 $R_c$ at high temperatures of at least 700°–900° F. and a room temperature hardness range of 30–35 $R_c$.

4. The insert as in claim 3, in which the composition consists of about 61% copper, about 31% nickel, about 6.1% aluminum and about 1.4% other alloying ingredients selected from the group consisting of manganese, titanium and iron along with normal processing impurities.

5. The material as in claim 4, in which the hardness of said material stabilizes in the range of 35–36 $R_c$ after the material has been exposed for 30–215 hours at a temperature level of about 700°–900° F.

6. An engine valve assembly comprising an exhaust valve consisting of iron based alloy and a valve seat facing material consisting essentially of about 40–70% copper, about 20–60% nickel and about 3–14% aluminum, said alloy being laser heated to provide high temperature resistant intermetallic compounds.

7. An engine valve assembly as in claim 6, in which said facing material comprises a cast material of Cu-Ni to which aluminum is laser alloyed, the resulting material consisting essentially of about 57–64% Cu, about 26–51% Ni, about 7–12% Al, and up to about 1.5% other alloying ingredients with the normal processing impurities.

8. An engine valve assembly as in claim 6, in which said facing material consists essentially of about 61% Cu, about 31% Ni, about 6.1% Al, and about 1.4% other alloying ingredients selected from the group consisting of Mn, Ti and Fe, along with normal processing impurities.

* * * * *